US012768569B2

(12) United States Patent
Thenappan et al.

(10) Patent No.: US 12,768,569 B2
(45) Date of Patent: Oct. 20, 2026

(54) WATER HEATER APPLIANCE AND METHODS FOR MODEL IDENTIFICATION

(71) Applicant: Haier US Appliance Solutions, Inc., Wilmington, DE (US)

(72) Inventors: Subbu Thenappan, Louisville, KY (US); Corey Sweatt, Palmyra, IN (US); Jacob Strader, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 432 days.

(21) Appl. No.: 18/427,299

(22) Filed: Jan. 30, 2024

(65) Prior Publication Data

US 2025/0244051 A1 Jul. 31, 2025

(51) Int. Cl.
*F24H 15/223* (2022.01)
*F24H 1/18* (2022.01)
(Continued)

(52) U.S. Cl.
CPC ..... *F24H 15/223* (2022.01); *F24H 1/18* (2013.01); *F24H 7/00* (2013.01); *F24H 9/20* (2013.01);
(Continued)

(58) Field of Classification Search
CPC . F24H 15/223; F24H 1/18; F24H 7/00; F24H 9/20; F24H 9/2035; F24H 15/104;
(Continued)

(56) References Cited

U.S. PATENT DOCUMENTS 10,240,817 B2 3/2019 Phillips et al.
11,543,153 B1 1/2023 Lyons, II et al.
(Continued)

FOREIGN PATENT DOCUMENTS

CN 111125891 A * 5/2020 ..... F24H 9/2021
CN 111948941 A * 11/2020 ..... G05B 13/042
(Continued)

OTHER PUBLICATIONS

CN-111125891-A translation (Year: 2026).*
CN-111948941-A translation (Year: 2026).*
CN_114111029_A translation (Year: 2026).*

*Primary Examiner* — Michael G Hoang
*Assistant Examiner* — Kurt J Wolford
(74) *Attorney, Agent, or Firm* — Dority & Manning, P.A.

(57) ABSTRACT

A water heater appliance may include a housing, a tank, a heating element, one or more temperature sensors, and a controller. The tank may be attached to the housing. The tank may define an interior volume. The heating element may be configured to heat water in the tank. The one or more temperature sensors may be attached to the housing. The controller may be mounted to the housing in operable communication with the heating element and the one or more temperature sensors. The controller may be configured to direct a water heating operation. The water heating operation may include directing a programmed diagnostic heating cycle, detecting an appliance temperature during the programmed diagnostic heating cycle, selecting an appliance model based on the detected appliance temperature, applying a predetermined model setting based on the selected appliance model, and directing a functional heating cycle according to the predetermined model setting.

18 Claims, 5 Drawing Sheets

(51) Int. Cl.

| | |
|---|---|
| ***F24H 7/00*** | (2022.01) |
| ***F24H 9/20*** | (2022.01) |
| ***F24H 15/104*** | (2022.01) |
| ***F24H 15/215*** | (2022.01) |
| ***F24H 15/219*** | (2022.01) |
| ***F24H 15/25*** | (2022.01) |
| ***F24H 15/429*** | (2022.01) |
| ***F24H 15/493*** | (2022.01) |

(52) U.S. Cl.
CPC ..... *F24H 9/2035* (2013.01); *F24H 15/104* (2022.01); *F24H 15/215* (2022.01); *F24H 15/219* (2022.01); *F24H 15/25* (2022.01); *F24H 9/2021* (2013.01); *F24H 15/429* (2022.01); *F24H 15/493* (2022.01)

(58) Field of Classification Search
CPC ..... F24H 15/215; F24H 15/219; F24H 15/25; F24H 9/2021; F24H 15/429; F24H 15/493
See application file for complete search history.

(56) References Cited

U.S. PATENT DOCUMENTS

| | | | | |
|---|---|---|---|---|
| 2014/0144395 | A1 | 5/2014 | Blessing et al. | |
| 2019/0277537 | A1* | 9/2019 | McCullough | F24H 15/225 |
| 2020/0004231 | A1* | 1/2020 | Anderson | F24H 15/36 |
| 2026/0043585 | A1* | 2/2026 | Miura | F24H 15/281 |

FOREIGN PATENT DOCUMENTS

| | | | | |
|---|---|---|---|---|
| CN | 114111029 A | * | 3/2022 | F24H 9/2021 |
| CN | 115143645 A | | 1/2023 | |
| KR | 102175513 B1 | | 11/2020 | |

* cited by examiner

WATER HEATER APPLIANCE AND METHODS FOR MODEL IDENTIFICATION

FIELD OF THE DISCLOSURE

The present subject matter relates generally to water heater appliances, and more particularly to systems and methods for improved operation.

BACKGROUND OF THE DISCLOSURE

A variety of energy sources are used in creating hot water for commercial and residential use including electric, solar, and various fuels. Natural gas and propane are preferred by some customers due to, for example, the relatively quick heating rate. These fuels are supplied as a gas that is burned in a combustion chamber to provide heat energy to raise the water temperature.

Although certain elements are common to most or many water heater appliances, many elements or features can vary between different models (e.g., burner or heating element configuration, tank capacity, tank shape, blower configuration, etc.). In order to account for these differences, the typical approach is to provide each model of water heater appliance with a different control board or program specifically tailored to the corresponding water heater appliance.

Challenges exist with these existing approaches. For instance, producing multiple different control boards or programs for different models of appliance may increase the manufacturing complexity or cost for each appliance. Additionally or alternatively, in some instances, it may be necessary to replace the control board of a particular water heater appliance unit, such as if the control board is damaged or broken after the unit is mounted or installed within a dwelling or office building. In response, a repairman or service professional will often remove the damaged or broken control board and install a new replacement control board (i.e., substitute control board). However, having to carry or remember programming details for multiple different control boards may be particularly burdensome.

As a result, it may be useful to provide an appliance or method to address one or more of the above identified issues.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a water heater appliance is provided. The water heater appliance may include a housing, a tank, a heating element, one or more temperature sensors, and a controller. The tank may be attached to the housing. The tank may define an interior volume for storage of water for heating. The heating element may be configured to heat water in the tank. The one or more temperature sensors may be attached to the housing. The controller may be mounted to the housing in operable communication with the heating element and the one or more temperature sensors. The controller may be configured to direct a water heating operation. The water heating operation may include directing a programmed diagnostic heating cycle, detecting an appliance temperature during the programmed diagnostic heating cycle, selecting an appliance model based on the detected appliance temperature, applying a predetermined model setting based on the selected appliance model, and directing a functional heating cycle according to the predetermined model setting.

In another exemplary aspect of the present disclosure, a method of operating a water heater appliance is provided. The method may include directing a programmed diagnostic heating cycle. The method may also include detecting an appliance temperature during the programmed diagnostic heating cycle and selecting an appliance model based on the detected appliance temperature. The method may further include applying a predetermined model setting based on the selected appliance model. The method may still further include directing a functional heating cycle according to the predetermined model setting.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
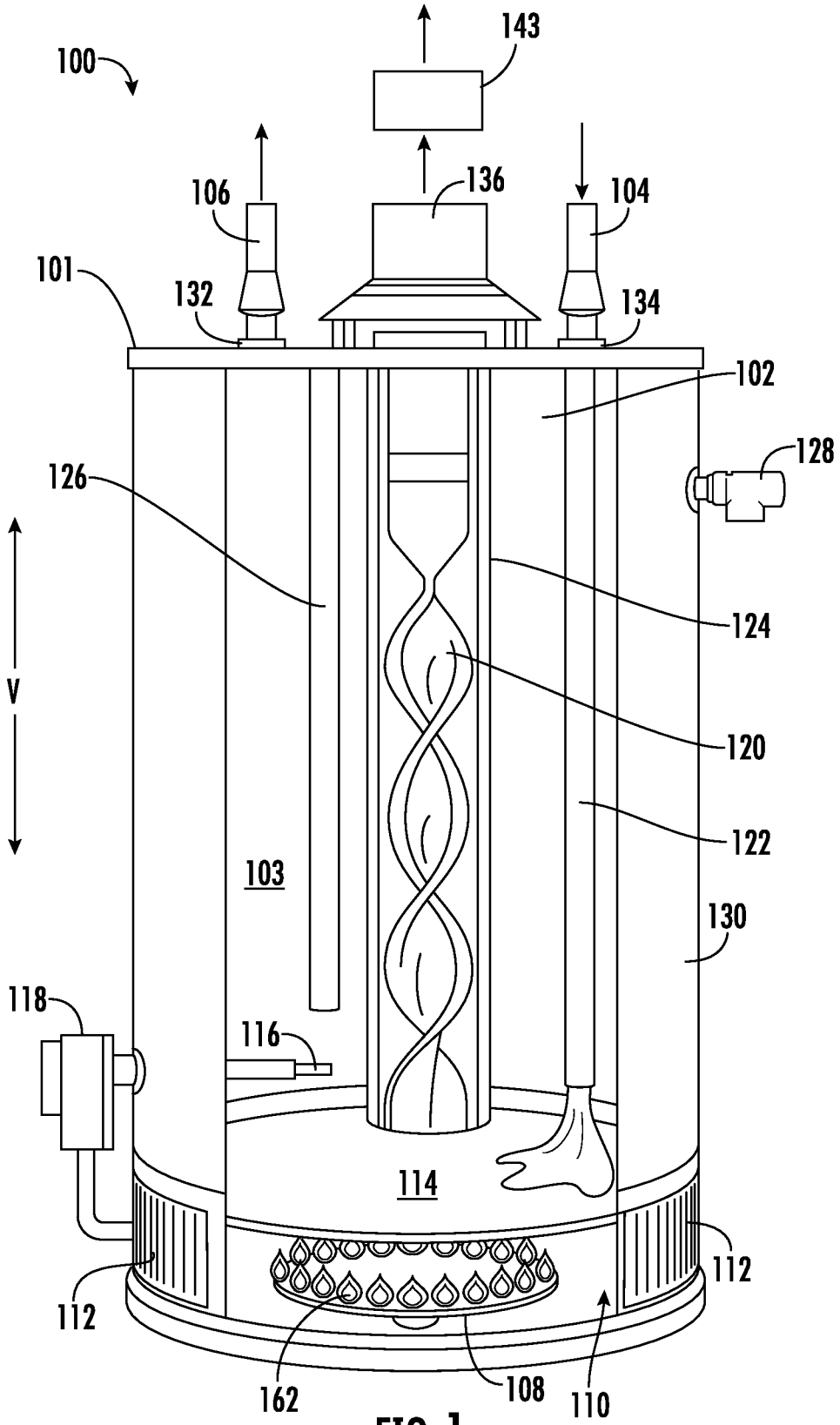
FIG. 1 provides a partially cut away, side view of an exemplary embodiment of a water heater of the present invention.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The terms "coupled," "fixed," "attached to," and the like refer to both direct coupling, fixing, or attaching, as well as indirect coupling, fixing, or attaching through one or more intermediate components or features, unless otherwise specified herein.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Notably, water heater appliances in accordance with the present disclosure may be able to effectively adjust or adapt to the specifics of their own model (e.g., automatically or without requiring a specialized control board or direct knowledge/input from a user or service technician). Thus, different models of water heater appliance (e.g., each having a different burner or heating element configuration, tank capacity, tank shape, or blower configuration) may be assembled with an identical controller or control board capable of operating each model differently.

Turning now to the figures, FIG. 1 illustrates a partial sectional, side view of an exemplary water heater 100 of the present invention. Generally, water heater appliance 100 has a housing 101 that includes an outer shell or casing. The casing generally attaches to (e.g., surrounds) a tank 102 where water is stored and heated. The tank 102 may be disposed within the casing or housing 101, generally. Housing 101 may be formed from a variety of components, such as with a wrapper and one or more covers, such as a top cover and a bottom cover. For instance, the top and bottom covers may be fastened or coupled to the wrapper to form the casing.

When assembled, water is supplied to tank 102 by inlet line 104. Heated water is supplied by tank 102 through outlet line 106. Water heater 100 is fluidly connected with lines 104 and 106 using connections 132 and 134. In turn, lines 104 and 106 connect with the water supply system of, for example, a residence or a commercial structure.

From line 104, water travels into tank 102 through a cold water dip tube 122 that extends along vertical direction V towards the bottom 114 of tank 102. After being heated, water exits tank 102 by travelling vertically upward and out through outlet line 106. Anode rod 126 provides protection against corrosion attacks on tank 102 and other metal components of water heater 100. A pressure relief valve 128 provides for a release of water from tank 102 in the event the pressure rises above a predetermined amount.

Water heater 100 includes a combustion chamber 110 in which a heating element (e.g., electrical heating element, such as a resistive heating element, or gas burner) 108 is centrally located. In embodiments wherein the heating element 108 includes a gas burner, the gas burner is supplied with a gaseous fuel (e.g., propane or natural gas). Air travels into combustion chamber 110 through air intake 112 in cabinet 130. The resulting mixture of air and gas is ignited and burned to heat bottom 114 of tank 102 and its water contents. Hot combustion gas exits combustion chamber 110 through a vent or flue 124 centrally located within tank 102. Heat exchange with flue 124 also helps heat water in tank 102. A baffle 120 promotes this heat exchange. Gas exits water heater 100 though vent hood 136, which may be connected with additional vent piping (not shown). In certain embodiments, a fan or blower 143 (e.g., axial fan, radial fan, tangential fan, etc.) is provided (e.g., in fluid communication with vent hood 136 or burner 164, generally). For instance, the blower 143 may be mounted above tank 102 downstream from vent hood 136 and configured to motivate or draw gas therealong. During use, activation or use of blower 143 may, in turn, further develop or control combustion at burner 164.

One or more tank temperature sensors (e.g., thermostat, thermistor, thermocouple, etc.) 116 may be attached to the tank 102 (e.g., on the outside thereof or within the interior volume 103). Generally, tank temperature sensor 116 may be measures the temperature of water in the interior volume 103 of tank 102. Tank temperature sensor 116 may be in operable (e.g., electrical or wireless) communication with a controller 154 or a gas control valve module 118 (e.g., directly or indirectly via controller 154). During use, tank temperature sensor 116 may provide a signal to gas control valve module 118. As used herein, "a signal" is not limited to a single measurement of temperature and, instead, may include multiple measurements over time or continuous measurements over time (e.g., as one or more interior volume temperatures (IVTs)). The signal may be provided through, for example, changes in current, voltage, resistance, or others. For instance, an output voltage from tank temperature sensor 116 may be proportional to the temperature or IVT value. Depending upon whether the desired temperature has been reached as determined (e.g., from the signal from tank temperature sensor 116), gas control valve module 118 regulates the flow of gas to burner 108, such as according to one or more set operational parameters, as would be understood.

Figure 2:
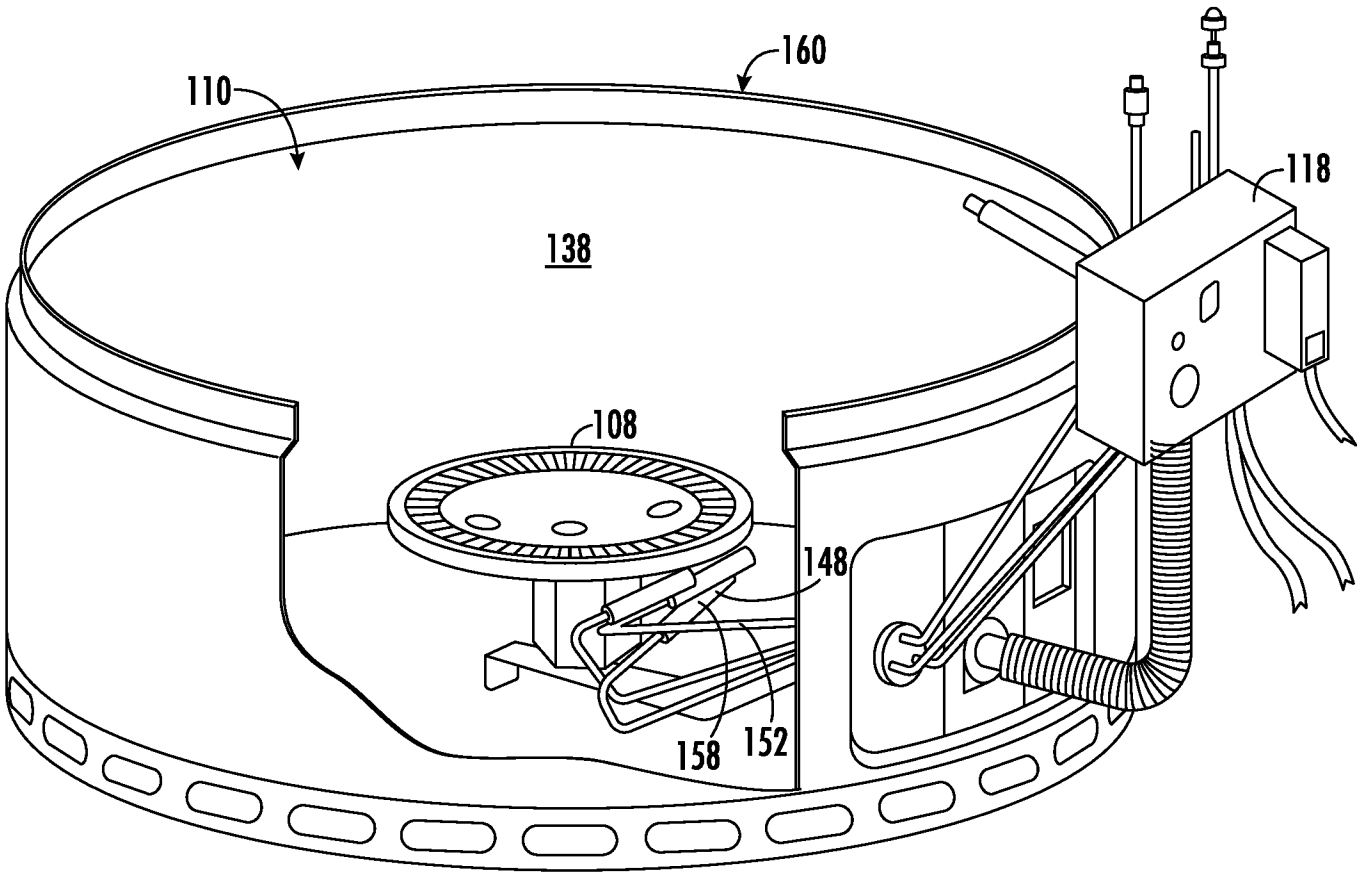
FIG. 2 provides a perspective view of an exemplary gas combustion chamber as may be used with the exemplary water heater of FIG. 1.
Figure 3A:
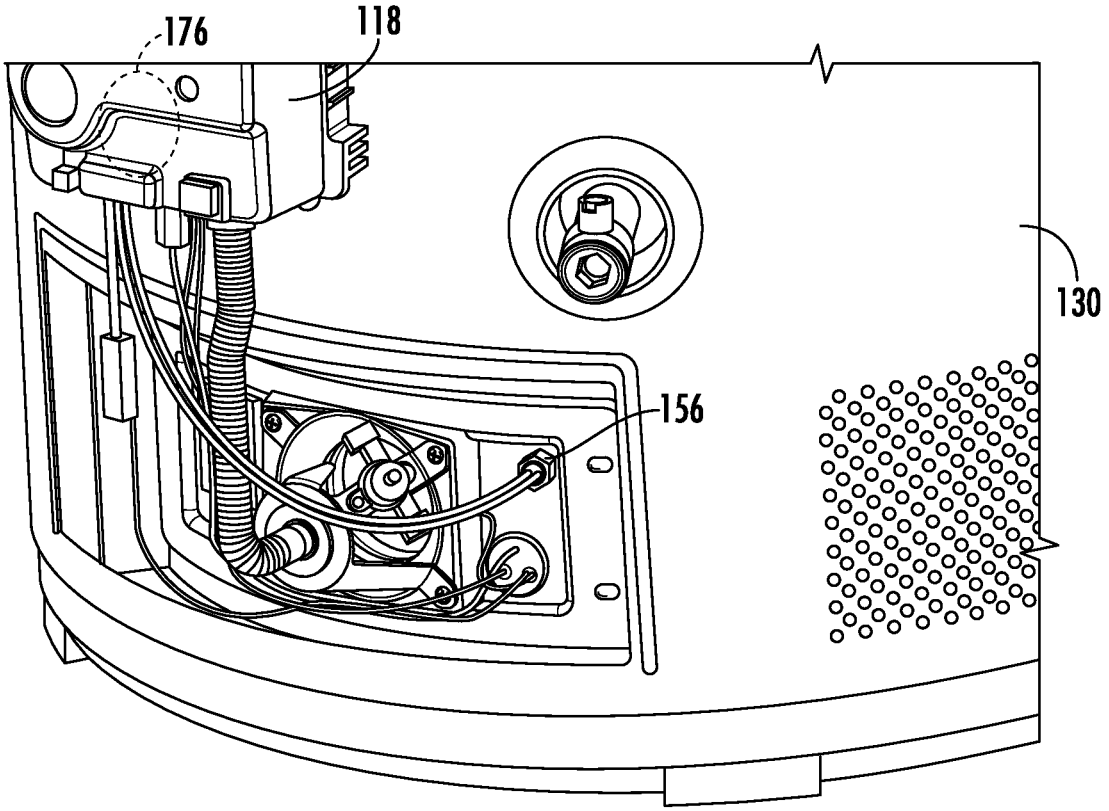
FIG. 3A provides a perspective view of certain exemplary components positioned adjacent to a combustion chamber as may be used with the exemplary water heater of FIG. 1.
Figure 3B:
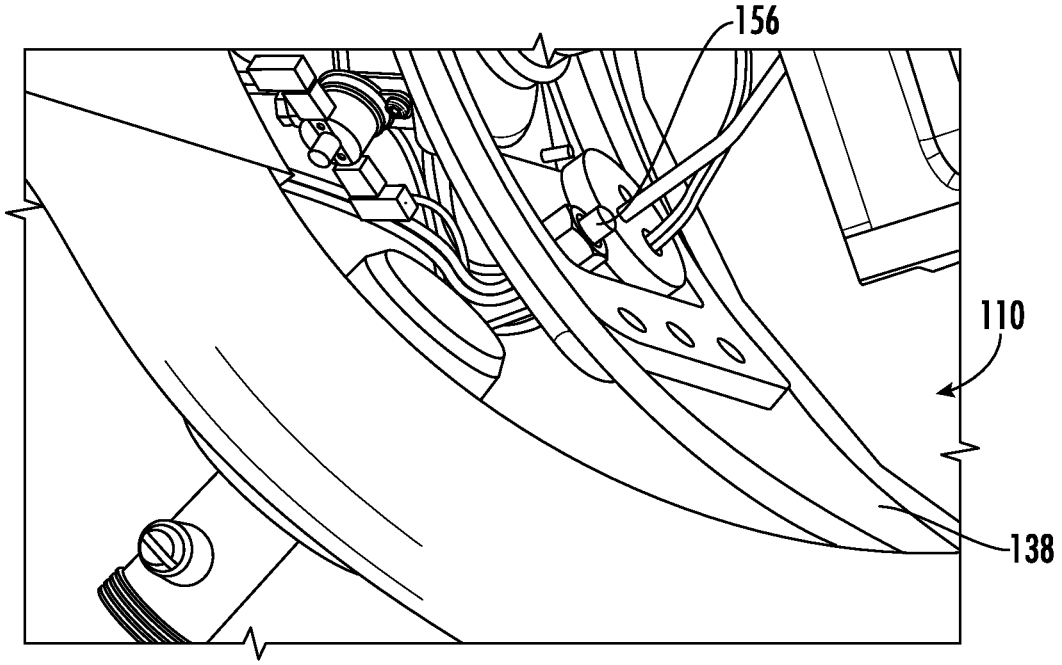
FIG. 3B provides another perspective view of certain exemplary components positioned adjacent to a combustion chamber as may be used with the exemplary water heater of FIG. 1.

Referring now to FIG. 2, combustion chamber 110 is formed by a chamber wall 138 that at least partially encloses combustion chamber 110 and may also provide support for tank 102 along top edge 160. As shown, chamber wall 138 encircles burner 108 and is spaced apart from burner 108. Chamber wall 138 may be part of cabinet 130 (FIG. 1) or may be a separate component.

Figure 4:
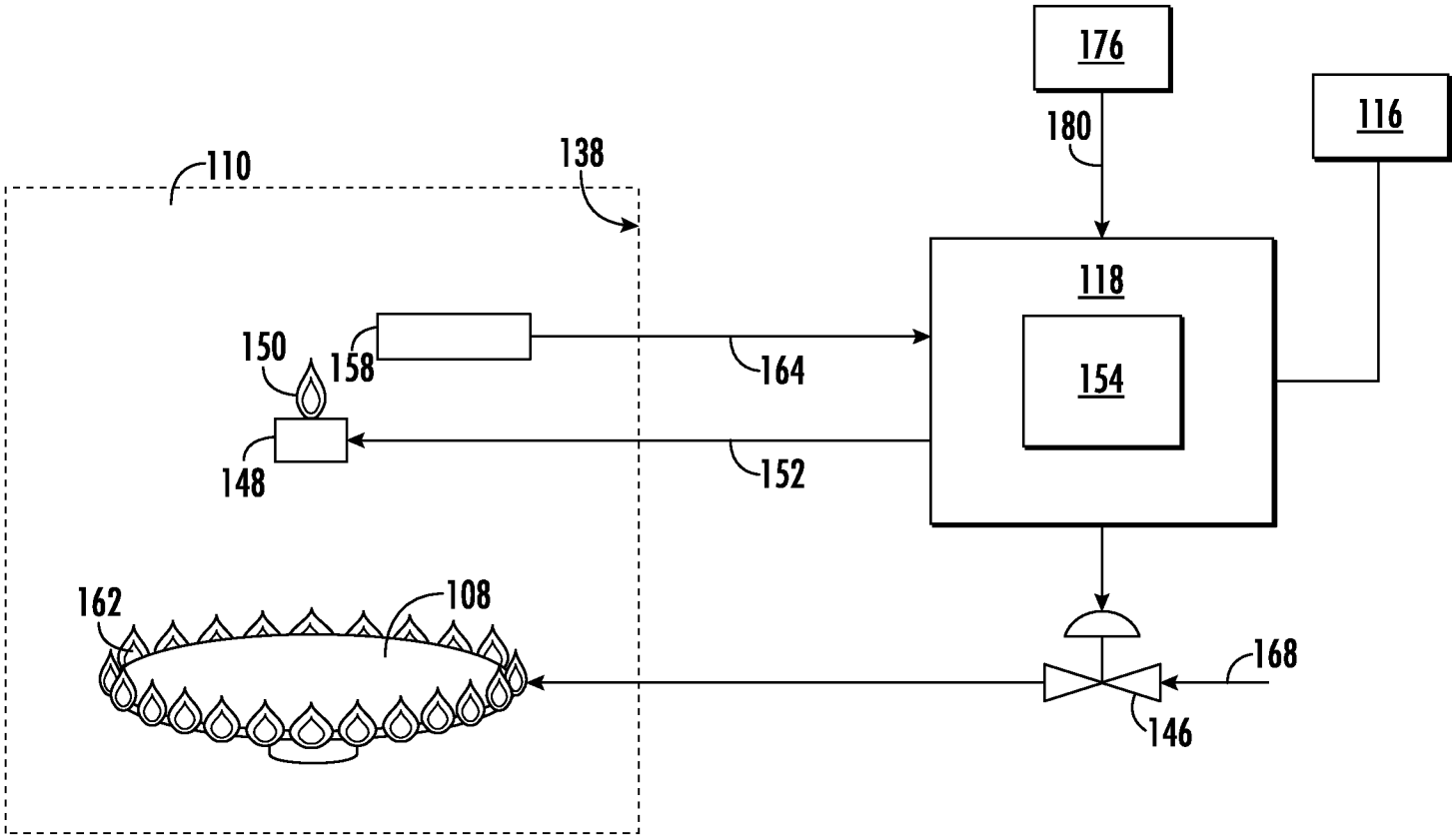
FIG. 4 is a schematic of a gas flow control system as may be used with the exemplary water heater of FIG. 1.

Turning especially to FIGS. 2 through 4, FIGS. 3A and 3B provide close-up perspective views of certain components positioned beneath and directly adjacent to gas burner 108. FIG. 4 provides a schematic representation of combustion chamber 110 and certain other components as will be further described.

In certain embodiments, gas valve control module 118 includes or is provided with to at least one controller 154. By way of example, controller 154 may include memory and one or more processing devices such as microprocessors, CPUs or the like, such as general or special purpose microprocessors operable to execute programming instructions or micro-control code associated with operation of water heater 100 as further described herein. The memory can represent random access memory such as DRAM, or read only memory such as ROM or FLASH. The processor executes programming instructions stored in the memory. The memory can be a separate component from the processor or can be included onboard within the processor. Alternatively, controller 154 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

In some embodiments, multiple discrete preset personalities (e.g., programming instructions including a predetermined model setting) corresponding different models for embodiments of the appliance 100 are stored in memory. Each of the plurality of preset personalities may direct certain elements to operate uniquely (e.g., in response to user selection or mode). For instance, each personality may include different predetermined setting having set parameter values for the heating element 108, gas valve 146, blower 143, etc. Such parameter values may include a control differential, a heating input rate (e.g., for the burner), blower speed or activation profile (e.g., dictating if, when, or how the blower 143 is activated), a water temperature setpoint (e.g., for the interior volume 103), a gas pressure (e.g., to be set at the gas valve), or combustion-chamber-temperature threshold (e.g., temperature for the combustion chamber 110 at which the heating element 108 will be deactivated or gas thereto is otherwise restricted). In some such embodiments, the parameter values may include or be provided as coefficients or constants configured to affect performance of the appliance in tandem with one or more variables (e.g., tank temperature, chamber temperature, etc.) measured during a functional heating cycle or operation of the appliance, generally. Thus, how or when the burner 108, gas valve 146, blower 143, or other elements are operated may be determined, at least in part, by the one of the preset personalities or predetermined model settings that is selected as the operating personality or setting.

As shown, water heater 100 includes a pilot burner 148 that provides a pilot light 150 (FIG. 4) to ignite a mixture of air and fuel at burner 108 when a gas valve 146 is open. An igniter 158 is positioned adjacent to pilot burner 148 and generates a spark used to ignite gaseous fuel and provide pilot light 150. Gaseous fuel for burner 108 is supplied by pilot burner fuel line 152. Gas valve control module 118 with controller 154 controls the flow of gaseous fuel through pilot burner fuel line 152 and the flow of gas to burner 108 from gaseous fuel supply 168.

In some embodiments, a chamber temperature sensor (i.e., chamber sensor) 156, which is generally configured to detect temperature, is positioned at or adjacent to the combustion chamber 110. For instance, chamber sensor 156 may be attached to chamber wall 138 (e.g., supported thereon). As shown, chamber sensor 156 may be disposed, at least in part, within combustion chamber 110. Generally, chamber sensor 156 may be any suitable temperature sensor (e.g., thermocouple, thermistor, IR sensor, etc.) configured to detect a temperature within combustion chamber 110 (e.g., as a signal or voltage corresponding to a combustion chamber temperature (CCT) value). For instance, an output voltage from chamber sensor 156 may be proportional to the temperature or CCT value within the combustion chamber 110 or at chamber sensor 156. The voltage signal transmitted to controller 154 (e.g., and interpreted thereby) through conductors may thus represent the measured CCT value.

Further separate from or in addition to chamber sensor 156, water heater 100 may include an ambient sensor 176. Ambient sensor 176 may be spaced apart from chamber sensor 156. In some embodiments, ambient sensor 176 is attached to the tank 102, such as indirectly or through the gas valve control module 118 (e.g., such that the ambient sensor 176 is generally fixed relative to the tank 102). For instance, ambient sensor 176 may be disposed within module 118 on or in operable (e.g., electrical or wireless) communication with controller 154. Generally, ambient sensor 176 is configured to detect temperature outside of the chamber 110 (e.g., directly or indirectly). In particular, ambient sensor 176 may be configured to detect an ambient temperature outside of combustion chamber 110 (e.g., as a voltage or corresponding ambient temperature (AT) value). In some such embodiment, ambient sensor 176 includes or is provided as a suitable temperature sensor (e.g., thermocouple, thermistor, IR sensor, etc.) configured to detect temperate outside of combustion chamber 110. For instance, an output voltage from ambient sensor 176 may be proportional to the temperature or AT value. The voltage signal transmitted to controller 154 (e.g., and interpreted thereby) through one or more conductors or wires 180 may thus represent the measured AT value. In additional or alternative embodiments, ambient sensor 176 communicates (e.g., wirelessly) with a separate probe or database (e.g., weather station) to receive an AT value detected apart from the tank 102 or water heater 100 generally.

In exemplary embodiments, water heater 100 includes a gas valve 146 positioned along main gas supply line 168.

Controller 154 is in communication with gas valve 146 (e.g., via module 118) to control the flow of gas therethrough, such as by determining when valve 146 is energized. As would be understood, a motor or solenoid may be included with gas valve 146, such as to electronically control the opening/closing of the gas valve 146. In optional embodiments, gas valve 146 may operate so that when energized, valve 146 is in a fully open operational position to allow a flow of gaseous fuel to burner 108. When not fully energized, valve 146 may fully closed (i.e. as a "fail-closed" type valve) so as to prevent the flow of gaseous fuel to burner 108. Nonetheless, it is understood that alternative embodiments of gas valve may be provided as a multi-position or otherwise variable valve configured to open to multiple different operational positions.

During use, opening or closing of valve 146 may generally be directed or controlled by controller 154. For instance, valve 146 may be directed to the open position to create a flame 162 at burner 108. Controller 154 may receive one or more signals (e.g., from tank temperature sensor 116) to determine whether the temperature of water in tank 102 has reached a desired setpoint temperature. In response to the same, the controller 154 may direct the valve 146 to the closed position. In some embodiments, an open interval (i.e., time period in which gas valve 146 is continuously opened or flame 162 is generated) may be demarcated or observed as a single cycle.

Figure 5:
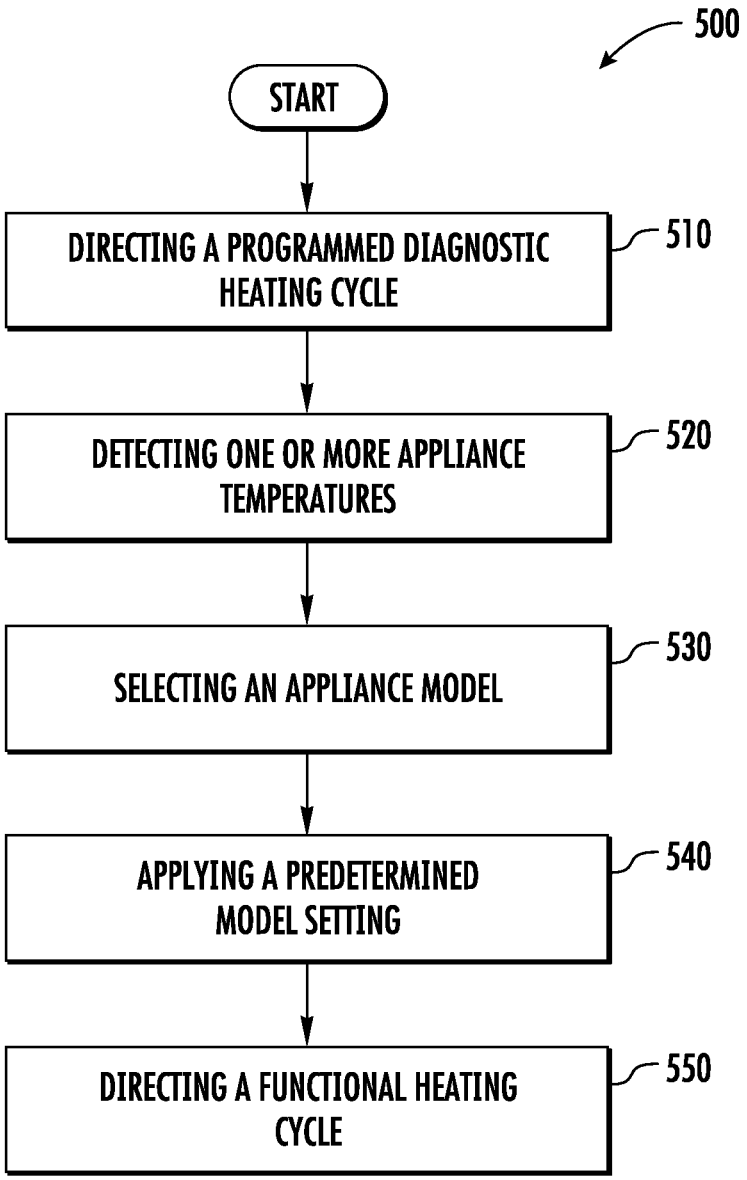
FIG. 5 provides a flow chart illustrating a method of operating a water heater appliance according to exemplary embodiments of the present disclosure.

Turning now to FIG. 5, the present disclosure may further be directed to methods (e.g., method 500) of operating a gas fueled water heater appliance, such as water heater appliance 100. In exemplary embodiments, the controller 154 may be operable to perform various steps of a method in accordance with the present disclosure.

The methods (e.g., 500) may occur as, or as part of, a water heating operation of water heater appliance 100. In particular, the methods (e.g., 500) disclosed herein may accurately detect excess temperatures within a combustion chamber, such as to maintain desired or safe operation while avoiding inaccurate or nuisance trips. Moreover, such methods may account for variations in ambient conditions.

It is noted that the order of steps within method 500 are for illustrative purposes. Except as otherwise indicated, one or more steps in the below method 500 may be changed, rearranged, performed in a different order, or otherwise modified without deviating from the scope of the present disclosure.

At 510, the method 500 includes directing a programmed diagnostic heating cycle. In particular, the heating element may be activated as part of the programmed diagnostic heating cycle (e.g., with or without activation of one or more other components controlled by the controller, such as the blower). Such a diagnostic heating cycle may be manually prompted by a user (e.g., at control panel) or in response to an initial activation (e.g., prompted by installation or reset of the water heater appliance).

In some embodiments, the burner is activated according to programmed steps or conditions. For instance, the gas valve may be directed to a predetermined operational position (e.g., prescribed as a predetermined set point, differential, or pressure at the gas valve). In other words, the gas valve may be at least partially opened as part of the programmed diagnostic heating cycle. Optionally, the predetermined operational position may be a fully open position (e.g., to permit the maximum flow rate of gaseous fuel to the burner). Alternatively, however, the predetermined operational position may be another, at least partially open, position between a fully closed or fully open position of the gas valve.

In exemplary embodiments, the diagnostic heating cycle may continue until a set endpoint condition is reached. Such as set endpoint condition may relate to or include one or more temperature measurements collected during the diagnostic heating cycle (e.g., as described below with respect to 520). As an example, the diagnostic heating cycle may provide for measuring temperature at or immediately prior to the start of the heating cycle (e.g., within the tank) as an initial temperature value. In some such embodiments, 510 includes determining an initial interior volume temperature (IVT) for the tank or water within the interior volume. Subsequent temperature measurements may be made throughout the diagnostic heating cycle (e.g., continuously or at a predetermined schedule or rate), such as until a predetermined temperature change value (e.g., relative to the initial temperature value or IVT). In turn or as a result, the diagnostic heating cycle may be halted or ended. Thus, the set endpoint condition may include a temperature change value. Optionally, the heating element may be deactivated (e.g., halting gas flow to the burner) in response to or as part of ending the diagnostic heating cycle.

At 520, the method 500 includes detecting one or more appliance temperatures during the diagnostic heating cycle of 510. Specifically, one or more temperature signals may be received from one or more temperature sensors over the duration of the diagnostic heating cycle or immediately following completion of the same. As an example, 520 may include detecting an interior temperature (IVT) value at the tank temperature sensor. During use, 520 may permit the controller to receive one or more signals from the tank temperature sensor to determine an IVT value (e.g., subsequent to the initial IVT value). Thus, the appliance temperature(s) of 520 may include or be provided as an IVT value (e.g., subsequent IVT value). Optionally, the controller may measure the interval value or value of time in which the water heater appliance requires to reach the IVT value. For instance, the controller may measure the time taken from the start of the diagnostic cycle until the set endpoint condition is met. Thus, the controller may measure the cycle time of the diagnostic cycle.

As an additional or alternative example, 520 may include detecting a combustion chamber temperature (CCT) value at the chamber sensor. During use, 520 may permit the controller to receive one or more signals from the chamber sensor to determine a CCT value. Thus, the appliance temperature(s) of 520 may include or be provided as a CCT value. Optionally, the CCT value may be detected in response to determining completion of the diagnostic heating cycle. In some such embodiments, then, the method 500 includes detecting a CCT value in response to determining completion of the set endpoint condition (e.g., determining a predetermined temperature change value has been reached at the tank temperature sensor).

At 530, the method 500 includes selecting an appliance model based on the detected appliance temperatures of 520. Thus, using one or more detected appliance temperatures (e.g., including values calculated from the same), a particular appliance model may be chosen (e.g., from a plurality of programmed appliance models).

In some embodiments, a reference module (e.g., empirical lookup table, chart, formula, or graph) is programmed in the controller and configured to match one or more input temperature variables to a plurality of water-heater personality profiles, each profile corresponding to a different appliance model. As an example, an appliance model may be selected based on cycle time required to reach the set endpoint temperature condition. Additionally or alternatively, the appliance model may be selected based on the CCT value (e.g., measured at the end or completion of the diagnostic cycle. In some such embodiments, a reference table having set values (or range of values) for cycle time and CCT value inputs can be used to match the inputs to a corresponding appliance model (e.g., personality).

At 540, the method 500 includes applying a predetermined model setting based on the selected appliance model of 530. As described above, each appliance model or personality may include a predetermined model setting for directing operation of the various components of the corresponding appliance model. The model setting may include various parameter values (e.g., corresponding to the heating element). In turn, the controller may have multiple control slots or bin into which the parameter values may be input to help direct or dictate operation of the water heater appliance.

At 550, the method 500 includes directing a functional heating cycle according to the predetermined model setting. Thus, the water heater appliance may operate to heat water within the tank (e.g., using the heating element to reach a setpoint temperature for water within the interior volume, as is generally understood) under the setting that corresponds to its particular model.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance, comprising:

a housing;

a tank attached to the housing, the tank defining an interior volume for storage of water for heating;

a heating element configured to heat water in the tank;

one or more temperature sensors attached to the housing; and a controller mounted to the housing in operable communication with the heating element and the one or more temperature sensors, the controller being configured to direct a water heating operation comprising directing a programmed diagnostic heating cycle, detecting an appliance temperature during the programmed diagnostic heating cycle, selecting an appliance model based on the detected appliance temperature, applying a predetermined model setting based on the selected appliance model, and directing a functional heating cycle according to the predetermined model setting.

2. The water heater appliance of claim 1, further comprising a gas valve, wherein the heating element comprises a gas burner positioned adjacent to the tank in fluid communication with the gas valve to receive fuel therefrom, wherein directing the programmed diagnostic heating cycle comprises directing the gas valve to a predetermined operational position.

3. The water heater appliance of claim 1, wherein directing the programmed diagnostic heating cycle comprises heating the interior volume until a set endpoint condition is met.

4. The water heater appliance of claim 3, wherein the set endpoint condition is a temperature change value.

5. The water heater appliance of claim 4, wherein the one or more temperature sensors comprise a tank temperature sensor attached to the tank, the tank temperature sensor being configured to detect temperature within the interior volume, wherein directing the programmed diagnostic heating cycle comprises determining an initial interior volume temperature (IVT), and wherein the appliance temperature comprises a subsequent IVT value detected at the tank temperature sensor following the initial IVT value.

6. The water heater appliance of claim 1, wherein the one or more temperature sensors comprise a tank temperature sensor attached to the tank, the tank temperature sensor being configured to detect temperature within the interior volume, and wherein the appliance temperature comprises an interior volume temperature (IVT) value detected at the tank temperature sensor.

7. The water heater appliance of claim 6, further comprising:

a chamber wall defining a combustion chamber; and a chamber sensor attached to the chamber wall, the chamber sensor being configured to detect temperature within the combustion chamber, wherein the heating element comprises a gas burner positioned adjacent to the tank and within the combustion chamber to heat water in the tank, wherein the water heating operation further comprises detecting a combustion chamber temperature (CCT) value at the chamber sensor during the programmed diagnostic heating cycle, and wherein selecting the appliance model is further based on detected CCT value.

8. The water heater appliance of claim 1, further comprising:

a chamber wall defining a combustion chamber, wherein the heating element comprises a gas burner positioned adjacent to the tank and within the combustion chamber to heat water in the tank, wherein the one or more temperature sensors comprise a chamber sensor attached to the chamber wall, the chamber sensor being configured to detect temperature within the combustion chamber, and wherein the appliance temperature comprises a combustion chamber temperature (CCT) value at the chamber sensor.

9. The water heater appliance of claim 1, wherein the predetermined model setting comprises parameter values corresponding to the heating element.

10. A method of operating a gas fueled water heater appliance comprising a housing, a tank defining an interior volume, a heating element, and one or more temperature sensors, the method comprising:

directing a programmed diagnostic heating cycle;

detecting an appliance temperature during the programmed diagnostic heating cycle;

selecting an appliance model based on the detected appliance temperature;

applying a predetermined model setting based on the selected appliance model; and directing a functional heating cycle according to the predetermined model setting.

11. The method of claim 10, wherein directing the programmed diagnostic heating cycle comprises directing a gas valve to a predetermined operational position.

12. The method of claim 10, wherein directing the programmed diagnostic heating cycle comprises heating the interior volume until a set endpoint condition is met.

13. The method of claim 12, wherein the set endpoint condition is a temperature change value.

14. The method of claim 13, wherein the one or more temperature sensors comprise a tank temperature sensor attached to the tank, wherein directing the programmed diagnostic heating cycle comprises determining an initial interior volume temperature (IVT), and wherein the appliance temperature comprises a subsequent IVT value detected at the tank temperature sensor following the initial IVT value.

15. The method of claim 10, wherein the one or more temperature sensors comprise a tank temperature sensor attached to the tank, and wherein the appliance temperature comprises an interior volume temperature (IVT) value detected at the tank temperature sensor.

16. The method of claim 15, wherein the water heater appliance further comprises a chamber sensor attached to a chamber wall of a combustion chamber, wherein the method further comprises:

detecting a combustion chamber temperature (CCT) value at the chamber sensor during the programmed diagnostic heating cycle, wherein selecting the appliance model is further based on detected CCT value.

17. The method of claim 10, wherein the one or more temperature sensors comprise a chamber sensor attached to a chamber wall of a combustion chamber, and wherein the appliance temperature comprises a combustion chamber temperature (CCT) value at the chamber sensor.

18. The method of claim 10, wherein the predetermined model setting comprises parameter values corresponding to the heating element.

* * * * *